US009680197B2

(12) United States Patent
Yen et al.

(10) Patent No.: US 9,680,197 B2
(45) Date of Patent: Jun. 13, 2017

(54) MICRO BANDPASS FILTER

(71) Applicant: National Tsing Hua University, Hsinchu (TW)

(72) Inventors: Ta-Jen Yen, Hsinchu (TW); Ruei-han Jiang, Hsinchu (TW); Yu-Kai Wang, Hsinchu (TW); Tsung-Yu Huang, Hsinchu (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 128 days.

(21) Appl. No.: 14/861,534

(22) Filed: Sep. 22, 2015

(65) Prior Publication Data

US 2016/0336633 A1 Nov. 17, 2016

(30) Foreign Application Priority Data

May 15, 2015 (TW) ..... 104115511 A

(51) Int. Cl.
*H01P 1/203* (2006.01)
*H01P 7/08* (2006.01)

(52) U.S. Cl.
CPC ..... *H01P 7/082* (2013.01); *H01P 1/20381* (2013.01)

(58) Field of Classification Search
CPC ..... H03H 7/0161; H01P 1/203
USPC ..... 333/202, 204, 205
See application file for complete search history.

(56) References Cited

U.S. PATENT DOCUMENTS 5,344,695 A * 9/1994 Hirai ..... H01P 1/203 333/205
5,977,847 A * 11/1999 Takahashi ..... H01P 1/2039 333/204
7,276,995 B2 * 10/2007 Hamada ..... H01P 1/20381 333/204
7,710,222 B2 * 5/2010 Koizumi ..... H01P 1/2013 333/204
7,982,559 B2 * 7/2011 Mori ..... H01P 1/20381 333/204
8,836,451 B2 * 9/2014 Yen ..... H01P 1/20363 333/204
9,225,050 B2 * 12/2015 Yen ..... H01P 1/20381
2007/0216498 A1 * 9/2007 Chen ..... H01P 1/2039 333/204

FOREIGN PATENT DOCUMENTS

TW I381574 B 1/2013

* cited by examiner

*Primary Examiner* — Dean Takaoka
(74) *Attorney, Agent, or Firm* — Muncy, Geissler, Olds & Lowe, P.C.

(57) ABSTRACT

A micro bandpass filter comprises a substrate, a first signal transmission member, a second signal transmission member and a resonator structure. The resonator structure includes a plurality of microstrip lines. The present invention realizes the function of a bandpass filter in a smaller area via curving the first signal transmission member, the second signal transmission member and the resonator structure.

9 Claims, 1 Drawing Sheet

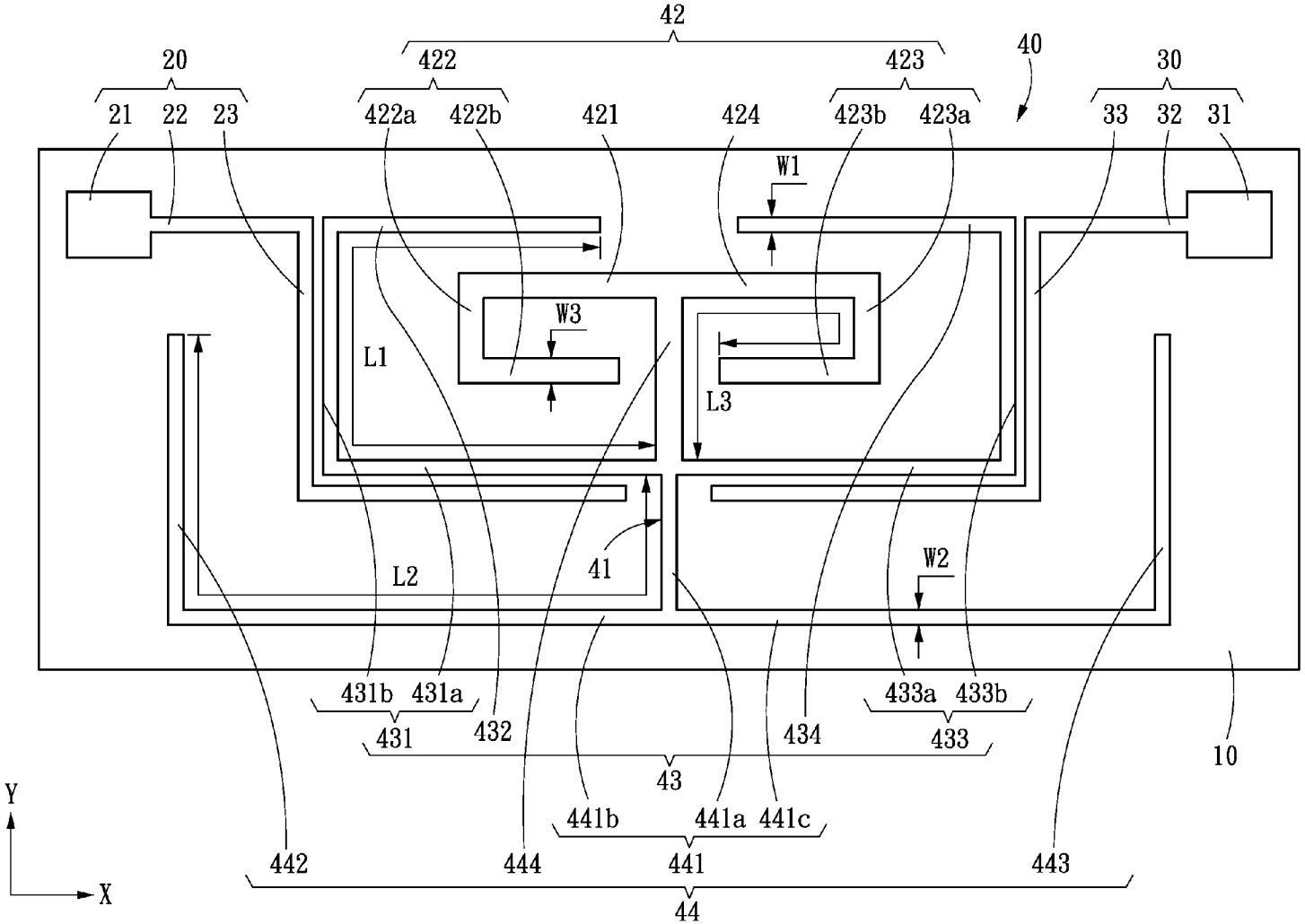
10
30
31
32
33
40
42
423
423a
423b
424
421
422
422b
422a
20
23
22
21
W1
W2
W3
L1
L2
L3
41
43
433
433a
433b
434
431
431a
431b
432
441
441a
441b
441c
442
443
444
44
X
Y

MICRO BANDPASS FILTER

FIELD OF THE INVENTION

The present invention relates to a bandpass filter, particularly to a micro bandpass filter having a reduced area.

BACKGROUND OF THE INVENTION

A bandpass filter receives signals of a specified frequency band and attenuates the signals outside the specified frequency band. With popularization of mobile communication and advance of wireless network technology, the bandpass filter, which can capture a given range of signals and exclude unnecessary noise, has been a critical element in mobile devices.

Among the conventional bandpass filters, a Taiwan patent No. 1381574 disclosed a "Dual-Band Bandpass Filter", which comprises a first resonator, a second resonator, a third resonator and a fourth resonator. A signal received by the first resonator is transmitted along the following two paths: in a first path, the signal is resonated by the first resonator and the second resonator and output by the second resonator; in a second path, the signal is resonated by the first resonator and a portion of the third resonator, then resonated by a portion of the third resonator and a portion of the fourth resonator, then resonated by a portion of the fourth resonator and a portion of the second resonator, and then output by the second resonator.

However, the first, second, third and fourth resonators of the conventional bandpass filter are wider and scarcely curved. Thus, the conventional bandpass filters have larger area. The mobile electronic devices (such as mobile phones and tablet computers) are growing more and more slim and lightweight to meet the requirement of consumers and the trend of the market. Therefore, developing a smaller-area bandpass filter has become an important subject in the related industry.

SUMMARY OF THE INVENTION

One objective of the present invention is to solve the problem that the conventional bandpass filter has too large an area.

To achieve the abovementioned objective, the present invention proposes a micro bandpass filter, which comprises a substrate, a first signal transmission member, a second signal transmission member and a resonator structure. The first signal transmission member is disposed on the substrate and includes a signal input terminal, a first impedance matching line and a first L-shaped coupling line, wherein the first impedance matching line is connected with the signal input terminal, and wherein the first L-shaped coupling line is connected with the first impedance matching line. The second signal transmission member is symmetric to the first signal transmission member and includes a signal output terminal, a second impedance matching line and a second L-shaped coupling line, wherein the second impedance matching line is connected with the signal output terminal, and wherein the second L-shaped coupling line is connected with the second impedance matching line.

The resonator structure includes a central region, a first resonator, a second resonator and a third resonator. The central region is disposed between the first L-shaped coupling line and the second L-shaped coupling line. The first resonator transversely extends from the central region toward two sides and includes a first L-shaped microstrip line, a first linear microstrip line, a second L-shaped microstrip line and a second linear microstrip line. The first L-shaped microstrip line extends transversely from the central region and neighbors the first L-shaped coupling line. The first linear microstrip line is connected with the first L-shaped microstrip line. The second L-shaped microstrip line is symmetric to the first L-shaped microstrip line, extends transversely from the central region and neighbors the second L-shaped coupling line. The second linear microstrip line is connected with the second L-shaped microstrip line.

The second resonator extends from the central region longitudinally toward two sides and includes a third linear microstrip line, an inverted-T microstrip line, a fourth linear microstrip line and a fifth linear microstrip line. The third linear microstrip line extends from the central region. The inverted-T microstrip line extends far away from the third linear microstrip line. The fourth linear microstrip line is connected with one end of the inverted-T microstrip line. The fifth linear microstrip line is symmetric to the fourth linear microstrip line and connected with another end of the inverted-T microstrip line.

The third resonator extends transversely from one end of the third linear microstrip line, which is far away from the central region, towards two sides and further includes a sixth linear microstrip line, a third L-shape microstrip line, a seventh linear microstrip line and a fourth L-shaped microstrip line. The sixth linear microstrip line extends transversely from one end of the third linear microstrip line, which is far away from the central region. The third L-shape microstrip line is connected with the sixth linear microstrip line. The seventh linear microstrip line is symmetric to the sixth linear microstrip line and extends transversely from one end of the third linear microstrip line, which is far away from the central region. The fourth L-shaped microstrip line is connected with the seventh linear microstrip line and symmetric to the third L-shape microstrip line.

From the above description, it is learned: the present invention realizes the function of a bandpass filter in a small area via curving the first signal transmission member, the second signal transmission and the resonator structure.

BRIEF DESCRIPTION OF THE INVENTION

The FIGURE is a diagram schematically showing the structure of a micro bandpass filter according to one embodiment of the present invention.

DETAILED DESCRIPTION OF THE PREFERRED EMBODIMENTS

The technical contents of the present invention are described in detail in cooperation with the drawings below.

Refer to the FIGURE, a diagram schematically showing the structure of a micro bandpass filter according to one embodiment of the present invention. The micro bandpass filter of the present invention comprises a substrate 10, a first signal transmission member 20, a second signal transmission member 30 and a resonator structure 40. The first signal transmission member 20 is disposed on the substrate 10 and includes a signal input terminal 21, a first impedance matching line 22 and a first L-shaped coupling line 23. The first impedance matching line 22 is connected with the signal input terminal 21, and the first L-shaped coupling line 23 is connected with the first impedance matching line 22. In one embodiment, each of the first impedance matching line 22 and the first L-shaped coupling line 23 has a width of 0.15 mm. The second signal transmission member 30 is symmetric to the first signal transmission member 20 and includes a signal output terminal 31, a second impedance matching line 32 and a second L-shaped coupling line 33. The second impedance matching line 32 is connected with the signal output terminal 31, and the second L-shaped coupling line 33 is connected with the second impedance matching line 32. In one embodiment, each of the second impedance matching line 32 and the second L-shaped coupling line 33 has a width of 0.15 mm.

The resonator structure 40 includes a central region 41, a first resonator 43, a second resonator 44 and a third resonator 42. The central region 41 is disposed between the first L-shaped coupling line 23 and the second L-shaped coupling line 33. The first resonator 43 transversely extends from the central region 41 toward two sides and includes a first L-shaped microstrip line 431, a first linear microstrip line 432, a second L-shaped microstrip line 433 and a second linear microstrip line 434. The first L-shaped microstrip line 431 extends transversely from the central region 41 and neighbors the first L-shaped coupling line 23. The first L-shaped microstrip line 431 further includes a first microstrip line 431*a* and a second microstrip line 431*b*. The first microstrip line 431*a* is connected with the central region 41 and extends along a second direction X. The second microstrip line 431*b* extends from the first microstrip line 431*a* along a first direction Y. The spacing between the first L-shaped microstrip line 431 and the first L-shaped coupling line 23 is 0.11 mm. The first linear microstrip line 432 is connected with the second microstrip line 431*b* of the first L-shaped microstrip line 431 and extends along the second direction X. The second L-shaped microstrip line 433 is symmetric to the first L-shaped microstrip line 431, extends transversely from the central region 41, and neighbors the second L-shaped coupling line 33. The second L-shaped microstrip line 433 further includes a third microstrip line 433*a* and a fourth microstrip line 433*b*. The third microstrip line 433*a* is symmetric to the first microstrip line 431*a* and connected with the central region 41, extending along the second direction X. The fourth microstrip line 433*b* is symmetric to the second microstrip line 431*b* and extends from the third microstrip line 433*a* along the first direction Y. The spacing between the second L-shaped microstrip line 433 and the second L-shaped coupling line 33 is 0.11 mm. The second linear microstrip line 434 is connected with the fourth microstrip line 433*b* of the second L-shaped microstrip line 433 and extends along the second direction X.

In one embodiment, the first L-shaped microstrip line 431 and first linear microstrip line 432 have a first total length L1 of 10.3 mm; the second L-shaped microstrip line 433 and the second linear microstrip line 434 have a total length identical to the first total length L1; each of the first L-shaped microstrip line 431, the first linear microstrip line 432, the second L-shaped microstrip line 433 and the second linear microstrip line 434 has a first width W1 of 0.12 mm.

The second resonator 44 extends from the central region 41 longitudinally toward two sides and includes a third linear microstrip line 444, an inverted-T microstrip line 441, a fourth linear microstrip line 442 and a fifth linear microstrip line 443. The third linear microstrip line 444 extends from the central region 41 along the first direction Y. The inverted-T microstrip line 441 extends far away from the third linear microstrip line 444 and further includes a fifth microstrip line 441*a*, a sixth microstrip line 441*b* and a seventh microstrip line 441*c*. The fifth microstrip line 441*a* is connected with the central region 41 and extends along the first direction Y. The sixth microstrip line 441*b* extends from the fifth microstrip line 441*a* and along the second direction X. The seventh microstrip line 441*c* is symmetric to the sixth microstrip line 441*b* and extends from the fifth microstrip line 441*a* and along the second direction X. The fourth linear microstrip line 442 is connected with the inverted-T microstrip line 441 through the sixth microstrip line 441*b* and extends along the first direction Y. The fifth linear microstrip line 443 is symmetric to the fourth linear microstrip line 442 and connected with the inverted-T microstrip line 441 through the seventh microstrip line 441*c* and extends along the first direction Y.

In one embodiment, the fifth microstrip line 441*a*, the sixth microstrip line 441*b* and the fourth linear microstrip line 442 have a second total length L2 of 11.1 mm; the fifth microstrip line 441*a*, the seventh microstrip line 441*c* and the fifth linear microstrip line 443 have a total length identical to the second total length L2; each of the inverted-T microstrip line 441, the fourth linear microstrip line 442 and the fifth linear microstrip line 443 has a second width W2 of 0.19 mm.

The third resonator 42 extends transversely from one end of the third linear microstrip line 444, which is far away from the central region 41, towards two sides and further includes a sixth linear microstrip line 421, a third L-shape microstrip line 422, a seventh linear microstrip line 424 and a fourth L-shaped microstrip line 423. The sixth linear microstrip line 421 extends transversely from one end of the third linear microstrip line 444, which is far away from the central region 41, along the second direction X. The third L-shaped microstrip line 422 is connected with the sixth linear microstrip line 421 and further includes an eighth microstrip line 422*a* and a ninth microstrip line 422*b*. The eighth microstrip line 422*a* extends from the sixth linear microstrip line 421 along the first direction Y. The ninth microstrip line 422*b* extends from the eighth microstrip line 422*a* along the second direction X. The seventh linear microstrip line 424 is symmetric to the sixth linear microstrip line 421 and extends transversely from one end of the third linear microstrip line 444, which is far away from the central region 41, along the second direction X. The fourth L-shaped microstrip line 423 is connected with the seventh linear microstrip line 424 and symmetric to the third L-shape microstrip line 422 and further includes a tenth microstrip line 423*a* and an eleventh microstrip line 423*b*. The tenth microstrip line 423*a* is symmetric to the eighth microstrip line 422*a* and connected with the seventh linear microstrip line 424. The eleventh microstrip line 423*b* is symmetric to the ninth microstrip line 422*b* and connected with the tenth microstrip line 423*a*.

In one embodiment, the third linear microstrip line 444, the seventh linear microstrip line 424, the tenth microstrip line 423*a* and the eleventh microstrip line 423*b* have a third total length L3 of 7.4 mm; the third linear microstrip line 444, the sixth linear microstrip line 421, the eighth microstrip line 422*a* and the ninth microstrip line 422*b* have a total length identical the third total length L3; each of the third linear microstrip line 444, the sixth linear microstrip line 421, the third L-shape microstrip line 422, the seventh linear microstrip line 424 and the fourth L-shaped microstrip line 423 has a third width W3 of 0.3 mm.

In the abovementioned embodiment, the micro bandpass filter has a central frequency of 5.375 GHz and a bandwidth of 0.95 GHz. Refer to Table. 1. While the first total length L1, the second total length L2 or the third total length L3 increase, the frequency decreases in the corresponding model. Oppositely, while the first total length L1, the second total length L2 or the third total length L3 decrease, the frequency increases in the corresponding model. Refer to Table. 2. While the first width W1, the second width W2 or the third width W3 increase, the frequency increases or decreases in the corresponding model. Therefore, the required central frequency and bandwidth can be obtained via adjusting the first total length L1, the second total length L2, the third total length L3, the first width W1, the second width W2 and the third width W3.

TABLE 1

| Parameter | Model |
|---|---|
| the first total length L1 increases | frequency decreases |
| the second total length L2 increases | frequency decreases |
| the third total length L3 increases | frequency decreases |
| the first total length L1 decreases | frequency increases |
| the second total length L2 decreases | frequency increases |
| the third total length L3 decreases | frequency increases |

TABLE 2

| | Model | | |
|---|---|---|---|
| Parameter | Low Frequency | Medium Frequency | High Frequency |
| the first width W1 increases | frequency decreases | frequency increases | frequency decreases |
| the second width W2 increases | frequency decreases | frequency increases | frequency decreases |
| the third width W3 increases | frequency increases | frequency decreases | frequency increases |

From the above discussion, it is learned: the present invention can realize the function of a bandpass filter in a smaller area via curving the first signal transmission member, the second signal transmission member and the resonator structure. Further, the present invention can acquire the desired central frequency and bandwidth via adjusting the first total length, the second total length, the third total length, the first width, the second width and the third width. Therefore, the present invention possesses utility, novelty and non-obviousness and has much improvement over the conventional technology. Thus, the present invention meets the condition for a patent. Hence, the Inventors file the application for a patent. It is appreciated if the patent is approved fast.

What is claimed is:

1. A micro bandpass filter comprising a substrate;

a first signal transmission member disposed on the substrate and including a signal input terminal, a first impedance matching line connected with the signal input terminal, and a first L-shaped coupling line connected with the first impedance matching line;

a second signal transmission member disposed on the substrate, symmetric to the first signal transmission member, and including a signal output terminal, a second impedance matching line connected with the signal output terminal, and a second L-shaped coupling line connected with the second impedance matching line; and a resonator structure including a central region disposed between the first L-shaped coupling line and the second L-shaped coupling line;

a first resonator transversely extending from the central region toward two sides and further including a first L-shaped microstrip line extending transversely from the central region and neighboring the first L-shaped coupling line; a first linear microstrip line connected with the first L-shaped microstrip line; a second L-shaped microstrip line symmetric to the first L-shaped microstrip line, extending transversely from the central region and neighboring the second L-shaped coupling line; and a second linear microstrip line connected with the second L-shaped microstrip line;

a second resonator extending from the central region longitudinally toward two sides and further including a third linear microstrip line extending longitudinally from the central region; an inverted-T microstrip line extending far away from the third linear microstrip line; a fourth linear microstrip line connected with the inverted-T microstrip line; and a fifth linear microstrip line symmetric to the fourth linear microstrip line and connected with the inverted-T microstrip line; and a third resonator extending transversely from one end of the third linear microstrip line, which is far away from the central region, towards two sides and further including a sixth linear microstrip line extending transversely from one end of the third linear microstrip line, which is far away from the central region; a third L-shape microstrip line connected with the sixth linear microstrip line; a seventh linear microstrip line symmetric to the sixth linear microstrip line and extending transversely from one end of the third linear microstrip line, which is far away from the central region; and a fourth L-shaped microstrip line connected with the seventh linear microstrip line and symmetric to the third L-shape microstrip line.

2. The micro bandpass filter according to claim 1, wherein the first L-shaped microstrip line and first linear microstrip line have a first total length of 10.3 mm; the second L-shaped microstrip line and the second linear microstrip line have a total length identical to the first total length.

3. The micro bandpass filter according to claim 1, wherein the inverted-T microstrip line further includes a fifth microstrip line connected with the central region and extending along a first direction; a sixth microstrip line extending from the fifth microstrip line and along a second direction; and a seventh microstrip line symmetric to the sixth microstrip line; and wherein the fourth linear microstrip line is connected with the sixth microstrip line and extends along the first direction; the fifth linear microstrip line is symmetric to the fourth linear microstrip line and connected with the seventh microstrip line; and wherein the fifth microstrip line, the sixth microstrip line and the fourth linear microstrip line have a second total length of 11.1 mm; the fifth microstrip line, the seventh microstrip line and the fifth linear microstrip line have a total length identical to the second total length.

4. The micro bandpass filter according to claim 1, wherein the third linear microstrip line extends along a first direction; the sixth linear microstrip line is connected with the third linear microstrip line and extends along a second direction; the third L-shaped microstrip line further includes an eighth microstrip line extending from the sixth linear microstrip line along the first direction and a ninth microstrip line extending from the eighth microstrip line along the second direction; the seventh linear microstrip line is connected with the third linear microstrip line and extends along the second direction; the fourth L-shaped microstrip line further includes a tenth microstrip line symmetric to the eighth microstrip line and connected with the seventh linear microstrip line and an eleventh microstrip line symmetric to the ninth microstrip line and connected with the tenth microstrip line; the third linear microstrip line, the seventh linear microstrip line, the tenth microstrip line and the eleventh microstrip line have a third total length of 7.4 mm; the third linear microstrip line, the sixth linear microstrip line, the eighth microstrip line and the ninth microstrip line have a total length identical the third total length.

5. The micro bandpass filter according to claim 1, wherein each of the first L-shaped microstrip line, the first linear microstrip line, the second L-shaped microstrip line and the second linear microstrip line has a first width of 0.12 mm.

6. The micro bandpass filter according to claim 1, wherein each of the inverted-T microstrip line, the fourth linear microstrip line and the fifth linear microstrip line has a second width of 0.19 mm.

7. The micro bandpass filter according to claim 1, wherein each of the third linear microstrip line, the sixth linear microstrip line, the third L-shape microstrip line, the seventh linear microstrip line and the fourth L-shaped microstrip line has a third width of 0.3 mm.

8. The micro bandpass filter according to claim 1, wherein each of the first impedance matching line, the first L-shaped coupling line, the second impedance matching line and the second L-shaped coupling line has a width of 0.15 mm.

9. The micro bandpass filter according to claim 1, wherein a distance between the first L-shaped microstrip line and the first L-shaped coupling line is 0.11 mm, and wherein a distance between the second L-shaped microstrip line and the second L-shaped coupling line is 0.11 mm.

* * * * *